US008157930B2

(12) United States Patent
Amaya et al.

(10) Patent No.: US 8,157,930 B2
(45) Date of Patent: Apr. 17, 2012

(54) MARTENSITIC STAINLESS STEEL

(75) Inventors: Hisashi Amaya, Kyoto (JP); Kunio Kondo, Sanda (JP); Masakatsu Ueda, Wakayama (JP); Keiichi Nakamura, Wakayama (JP); Takahiro Kushida, Amagasaki (JP); Kazuyo Kushida, legal representative, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/798,855

(22) Filed: Mar. 12, 2004

(65) Prior Publication Data

US 2005/0034790 A1 Feb. 17, 2005

Related U.S. Application Data

(63) Continuation of application No. PCT/JP02/10395, filed on Oct. 4, 2002.

(30) Foreign Application Priority Data

Oct. 18, 2001 (JP) ..... 2001-320372
Jul. 30, 2002 (JP) ..... 2002-221918

(51) Int. Cl.
*C22C 38/22* (2006.01)
*C21D 8/02* (2006.01)

(52) U.S. Cl. ..... 148/325; 420/34; 148/579

(58) Field of Classification Search ..... 148/325, 148/547, 579; 420/34
See application file for complete search history.

(56) References Cited

U.S. PATENT DOCUMENTS 2,799,602 A * 7/1957 Lena ..... 148/506
4,326,885 A 4/1982 Larson et al.
4,878,955 A * 11/1989 Hoshino et al. ..... 148/610
5,089,067 A * 2/1992 Schumacher ..... 148/325
5,232,520 A * 8/1993 Oka et al. ..... 148/542
5,624,504 A * 4/1997 Miyakusu et al. ..... 148/325
5,716,465 A * 2/1998 Hara et al. ..... 148/325
5,858,128 A * 1/1999 Miyata et al. ..... 148/325

(Continued)

FOREIGN PATENT DOCUMENTS

CN 1138880 12/1996

(Continued)

OTHER PUBLICATIONS

ASM International, Materials Park, Ohio, Metallographer's Guide: Practices and Procedures for Irons and Steels, Chapter 1, Introduction to Steels and Cast Irons: p. 3, 1999.*

(Continued)

*Primary Examiner* — Jessee R. Roe
(74) *Attorney, Agent, or Firm* — Clark & Brody

(57) ABSTRACT

A martensitic stainless steel comprising C: 0.01-0.10%, Si: 0.05-1.0%, Mn: 0.05-1.5%, P: not more than 0.03%, S: not more than 0.01%, Cr: 9-15%, Ni: 0.1-4.5%, Al: not more than 0.05% and N: not more than 0.1% in mass %, and further comprising at least one of Cu: 0.05-5% and Mo: 0.05-5%, the residual being Fe and impurities, is provided, wherein the contents of Cu and Mo satisfy the following formula (a) or (b), $$0.2\% \leqq Mo+Cu/4 \leqq 5\% \quad (a)$$

$$0.55\% \leqq Mo+Cu/4 \leqq 5\% \quad (b)$$

and wherein the hardness is 30-45 in HRC and the carbide amount in grain boundaries of the prior austenite is not more than 0.5 volume %. The marensitic stainless steel has excellent properties regarding the sulfide stress cracking resistance, the resistance to corrosive wear and the localized corrosion.

8 Claims, 1 Drawing Sheet

U.S. PATENT DOCUMENTS

| | | | | |
|---|---|---|---|---|
| 5,979,614 | A * | 11/1999 | Takahashi et al. | 188/218 XL |
| 6,379,821 | B2 * | 4/2002 | Kushida et al. | 428/685 |
| 6,464,803 | B1 * | 10/2002 | Tendo et al. | 148/325 |
| 6,488,786 | B2 * | 12/2002 | Hiramatsu et al. | 148/325 |
| 6,576,186 | B1 * | 6/2003 | Martin et al. | 420/60 |
| 6,716,291 | B1 * | 4/2004 | Woods | 148/325 |
| 6,793,744 | B1 * | 9/2004 | Jung | 148/325 |
| 2001/0017173 | A1 * | 8/2001 | Hiramatsu et al. | 148/325 |

FOREIGN PATENT DOCUMENTS

| | | | |
|---|---|---|---|
| EP | 0384317 | | 2/1990 |
| EP | 06100935 | | 4/1994 |
| EP | 0732418 | | 9/1996 |
| EP | 0798394 | | 10/1997 |
| EP | 1026273 | | 8/2000 |
| GB | 1214293 | | 12/1970 |
| JP | 02-243740 | | 9/1990 |
| JP | 02-247360 | | 10/1990 |
| JP | 06100935 | | 4/1994 |
| JP | 06-264192 | | 9/1994 |
| JP | 07-118734 | | 5/1995 |
| JP | 09-041093 | * | 2/1997 |
| JP | 11-310823 | * | 11/1999 |
| JP | 2001-152295 | * | 6/2001 |
| WO | WO 96/10654 | | 4/1996 |

OTHER PUBLICATIONS

The ASM Handbook: Tempering of Steel, Aug. 31, 1991, vol. 4, pp. 124.*

ASM International, Materials Park, Ohio, Properties and Selection: Irons, Steels, and High Performance Alloys, "Classification and Designation of Carbon and Low Alloy Steels", pp. 144-145, Mar. 1990.*

English Abstract and English Machine Translation of Oka et al. (JP 11-310823) (1999).*

* cited by examiner

MARTENSITIC STAINLESS STEEL

This application is a continuation of International Patent Application No. PCT/JP02/10395, filed Oct. 4, 2002. This PCT application was not in English as published under PCT Article 21(2)

TECHNICAL FIELD

The present invention relates to a martensitic stainless steel, which has a high mechanical strength and excellent properties regarding corrosive resistance, such as the sulfide stress cracking resistance, the resistance to corrosive wear, localized corrosion resistance, and which is useful as a steel material for oil country tubular goods, line pipes or tanks which are employed in the drilling and production of an oil well or a gas well (hereinafter these being simply referred to as "oil well") for oil or natural gas containing carbon dioxide and a very small amount of hydrogen sulfide, as well as in the transportation and storage thereof.

BACKGROUND ART

Since most of oil or natural gas produced in an oil well contains wet carbon dioxide ($CO_2$), either an inhibiter is used in a carbon steel or a martensitic stainless steel containing 13% Cr is employed in order to protect the corrosion of either oil country tubular goods, such as tubing used for drilling and production of an oil well, or line pipes used for transportation. In particular, 13% Cr steel is widely used, because it has a good corrosion resistance in an environment containing wet carbon dioxide and steadily provides high mechanical strength. However, it is known that the 13% Cr steel often provides sulfide stress cracking when used in an environment containing hydrogen sulfide ($H_2S$), thereby causing its usage to be restricted.

In recent years, the environment of an oil well from which oil or natural gas is produced increasingly has become severe. Most of the oil well containing carbon dioxide contains a very small amount of hydrogen sulfide. Even in an oil well containing only carbon dioxide in the initial stage, a very small amount of hydrogen sulfide is generated little by little as it is used. In this case, moreover, a problem has to be taken for corrosion resulting from a fluid flowing at a high speed, i.e., a corrosive wear.

It is empirically recognized that the restriction of the highest hardness is effective to reduce the sensitivity to sulfide stress cracking of 13% Cr steel. For instance, in NACE MR0175, the highest hardness has been specified so as to be restricted to 22 in HRC (Rockwell hardness in scale C), when 13% Cr steel, e.g., SUS 420 steel is used in a corrosive environment containing hydrogen sulfide.

Recently, the above 13% Cr steel has been improved so as to be used in a much severer corrosive environment, so that an improved type 13% Cr steel containing an extremely small amount of carbon and an appropriate amount of nickel in spite thereof has been developed. Even in this steel, the highest hardness is restricted to 27 in HRC (see NACE MR0175-2001).

With regard to the above-mentioned improved type 13% Cr steel, several steels having a high mechanical strength and an excellent corrosion resistance have been proposed. For instance, in Japanese Patent Application Laid-open No. 2-243740, a martensitic stainless steel having a high mechanical strength and an excellent corrosion resistance even in the state of being either hot worked or quenched is disclosed, in which case, not only Ni but also Mo is added thereto. Moreover, in Japanese Patent Application Laid-open No. 2-247360, a martensitic stainless steel having a high mechanical strength, together with excellent corrosion resistance in carbon dioxide environment and excellent stress corrosion cracking resistance, has been proposed, where a specific amount of Cu is contained in the 13% Cr steel.

The proposed steels pertain to 13% Cr steel having a specified magnitude for the highest hardness as well as a high mechanical strength and excellent corrosion resistance, and these steels further have an excellent corrosion resistance in a corrosive environment containing carbon dioxide and a very small amount of hydrogen sulfide. Nevertheless, the resistance to the corrosive wear cannot be obtained with these steels.

In other words, the steel has to satisfy both the corrosion resistance in carbon dioxide and the sulfide stress cracking resistance in order to ensure the resistance to corrosive wear in a very severe oil well environment, and the steel also has to increase the hardness in order to enhance the resistance to corrosive wear. However, the 13% Cr steel having a restricted magnitude in the highest hardness can hardly satisfy the resistance to corrosive wear in an increasing severity of oil well environment.

On the other hand, a technology capable of enhancing the resistance to corrosive wear in a martensitic stainless steel is disclosed. In Japanese Patent Application Laid-open No. 6-264192 and No. 7-118734, martensitic stainless steels having a high mechanical strength and excellent resistance to corrosive wear are described, where nickel is added in a high content to the 13% Cr steels. These steels are normally used in a steel material or a welded structure having a high mechanical strength, wherein it is important to suppress the cavitation-erosion resulting from cavities in a hydrofoil or a facility of sand drainage. However, these steels are not useful for using in an environment of corrosive wear due to the fluid flown at a high speed in a corrosive environment.

DISCLOSURE OF THE INVENTION

An increase in the hardness of 13% Cr steel tends to induce sulfide stress cracking in an environment containing hydrogen sulfide. On the other hand, an increase in the hardness is required to enhance the resistance to corrosive wear for the steel. As a result, a precise control of both the mechanical strength and the hardness is required in the manufacture of such 13% Cr steel.

In 13% Cr steels, subsequent treatments of quenching and tempering are normally carried out after hot worked. In the course of these treatments, carbides are precipitated in grain boundaries, when passing through the temperature range in the tempering, thereby causing the localized corrosion resistance to be reduced, as is commonly known in the 13% Cr steels. Since it is necessary to control the mechanical strength and the hardness in order to ensure the sulfide stress cracking resistance, the treatment of tempering after the quenching is an essential process for producing such 13% Cr steel.

Therefore, in the conventional method for manufacturing 13% Cr steel, it is difficult to simultaneously satisfy the sulfide stress cracking resistance, the resistance to corrosive wear and the localized corrosion resistance, which are all required in the case of a severe oil well environment.

In view of the problems encountered for the conventional 13% Cr steel, it is an object of the present invention to provide a martensitic stainless steel, which has excellent properties regarding the sulfide stress cracking resistance, the resistance to corrosive wear and the localized corrosion resistance, and which are effectively used in a steel material for a steel pipe used in drilling and production of an oil well as well as for a tank in the transportation and storage of oil, wherein the martensitic stainless steel is produced by properly specifying the chemical composition and at the same time by controlling the hardness is controlled and by suppressing the amount of carbides in the grain boundaries.

To attain the above-mentioned object, the present inventors investigated relevant properties for using various types of steels having martensitic structure either as worked or as quenched after hot working, and it was found that the steel, either as hot worked or as quenched satisfied, not only the sulfide stress cracking resistance, but also the resistance to corrosive wear and the localized corrosion resistance.

In fact, a material of 0.04% C-11% Cr-2% Ni—Cu—Mo steel was hot worked to produce steel pipes having martensitic structure, either as hot worked or as quenched. The test for the sulfide stress cracking was made for the pipes thus produced, and it was found that no cracks observed even for the steels having such a high hardness as 35 in HRC.

Subsequently, the corrosive wear test was made for steel pipes having a hardness of 35 in HRC in the quenched state, and it was confirmed that an excellent resistance to corrosive wear was obtained. For the purpose of comparison, a similar corrosive wear test was made for a steel pipe having a hardness of about 22 in HRC after the tempering, and it was found that a much more excellent resistance to corrosive wear was obtained by the steel pipe having such a high hardness as 35 in HRC in the quenched state, compared with the steel pipe having a relatively small hardness in the tempered state.

Moreover, for the above-mentioned steel pipes, the localized corrosion resistance was examined at 150° C. in a corrosive environment of $H_2S+CO_2$, exhibiting pH 3.75 or pH 4.0, and it was found that the localized corrosion generated for the quenched and the tempered materials having a carbide amount of 0.7 volume %, whereas no localized corrosion generated for the material having a carbide amount of 0.07 volume % or so, either as hot worked or as quenched.

From these results, it is clear that 13% Cr steel either as hot worked or as quenched provides excellent properties as for the sulfide stress cracking resistance, the resistance to corrosive wear and the localized corrosion resistance. In a systematic investigation so far made using various martensitic stainless steels having different chemical compositions from each other, the following facts [1] to [3] can be clarified:

[1] The formation of a sulfide layer on a chromium oxide film grown on the surface of steel enhances sulfide stress cracking resistance in a corrosive environment containing a very small amount of $H_2S$. In particular, a mixture of a copper sulfide and a molybdenum sulfide provides a very fine and dense layer, and therefore provides a protection effect on the chromium oxide film. The desired contents of Cu and Mo in the steel depend on the state of the corrosive environment. From the results of evaluating the stress corrosion resistance under varied corrosive environments (pH conditions), it is found that the contents of Cu and Mo should satisfy the following formula (a) or (b):

$$0.2\% \leqq Mo+Cu/4 \leqq 5\% \quad (a)$$

$$0.55\% \leqq Mo+Cu/4 \leqq 5\% \quad (b)$$

The difference in the application of the formula (a) or (b) is due to the difference in the corrosive environment.

[2] Electron microscopic observation reveals that a greater amount of $M_{23}C_6$ type carbides concentrate in prior austenite grain boundaries of a tempered steel, whereas no such $M_{23}C_6$ type carbides exist in the prior austenite boundaries of the steel either as hot worked or as quenched. The measurement of the carbide amount shows that an excellent sulfide stress cracking resistance can be obtained, when the carbide amount in the prior austenite grain boundaries is not more than 0.5 volume %.

[3] An increase in the hardness of the steel is effective for a proper resistance to corrosive wear. In particular, a hardness of 30 in HRC is necessary to attain a high resistance to corrosive wear in a corrosive environment containing $CO_2$ and a very small amount of $H_2S$.

The present invention is constructed on the basis of the above experimental findings and provides the following martensitic stainless steels (1) to (3). The martensitic stainless steels according to the invention are effective for using in a corrosive environment. It is assumed that the martensitic stainless steel (1) may be advantageously used in a corrosive environment of not less than pH 4.0 whereas the martensitic stainless steel (2) may be advantageously used in a corrosive environment of not less than pH 3.75.

(1) A martensitic stainless steel comprising C, 0.01-0.10%, Si: 0.05-1.0%, Mn: 0.05-1.5%, P: not more than 0.03%, S: not more than 0.01%, Cr: 9-15%, Ni: 0.1-4.5%, Al: not more than 0.05% and N: not more than 0.1%, and further comprising at least one of Cu: 0.05-5% and Mo: 0.05-5% in mass %, the residual being Fe and impurities, wherein the contents of Cu and Mo satisfy the following formula (a), $$0.2\% \leqq Mo+Cu/4 \leqq 5\% \quad (a)$$

and wherein the hardness is 30-45 in HRC and the amount of carbides in grain boundaries of the prior austenite is not more than 0.5 volume %.

(2) A martensitic stainless steel comprising C, 0.01-0.10%, Si: 0.05-1.0%, Mn: 0.05-1.5%, P: not more than 0.03%, S: not more than 0.01%, Cr: 9-15%, Ni: 0.1-4.5%, Al: 0.05% and N: not more than 0.1%, and further comprising at least one of Cu: 0-5% and Mo: 0-5% in mass %, the residual being Fe and impurities, wherein the contents of Cu and Mo satisfy the following formula (b), $$0.55\% \leqq Mo+Cu/4 \leqq 5\% \quad (b)$$

and wherein the hardness is 30-45 in HRC and the amount of carbides in grain boundaries of the prior austenite is not more than 0.5 volume %.

(3) The martensitic stainless steel (1) or (2) may contain one or more elements in the following Groups A and B, if required:

Group A; Ti: 0.005-0.5%, V: 0.005-0.5% and Nb: 0.005-0.5% in mass %, and

Group B; B: 0.0002-0.005%, Ca: 0.0003-0.005%, Mg: 0.0003-0.005% and rare earth elements: 0.0003-0.005% in mass %.

BEST MODE FOR CARRYING OUT THE INVENTION

Figure 1:
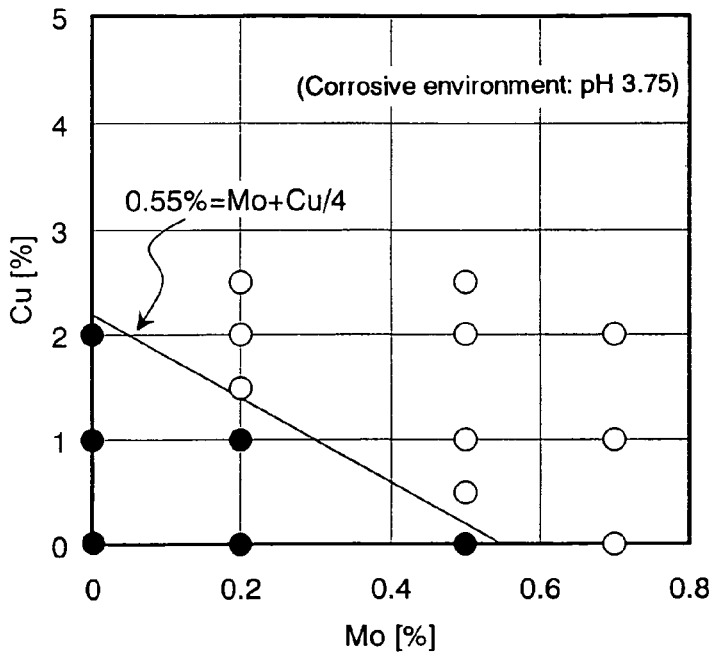
FIG. 1 is a diagram showing the influence of Mo and Cu contents on the sulfide stress cracking resistance in a corrosive environment of pH 3.75.

In the present invention, the chemical composition, the metal structure and the hardness of the steels are specified as above. The reason for such specification will be described. Firstly, the chemical composition of the martensitic stainless steel according to the invention will be described. In the following description, the chemical composition is expressed by mass %.

1. Chemical composition of steel

C: 0.01-0.10%

Carbon is an effective element for forming austenite. Since the increase of the content of carbon in the steel decreases the content of Nickel, which is also an effective element for forming austenite, carbon is preferably contained at a content of not less than 0.01%. However, a C content of more than 0.10% causes the corrosion resistance to be deteriorated in an environment containing $CO_2$. Accordingly, the C content should be set to be 0.01-0.10%. To decrease the Ni content, it is desirable that the C content is not less than 0.02%. A preferable range should be 0.02-0.08% and a more preferable range should be 0.03-0.08%. Si: 0.05-1.0%

Silicon is an element serving as a deoxidizer. A Si content of less than 0.05% causes the aluminum loss to be increased in the stage of deoxidization. On the other hand, a Si content of more than 1.0% causes the toughness to be decreased. Accordingly, the Si content should be set to be 0.05-1.0%. A preferable range should be 0.10-0.8% and a more preferable range should be 0.10-0.6%.

Mn: 0.05-1.5%

Manganese is an effective element for increasing the mechanical strength of steel and it is an effective element for forming austenite to form the martensite phase, and thereby to stabilize the metal structure in the quenching treatment of steel material. An Mn content of less than 0.05% is too small to form the martensite phase. However, an Mn content of more than 1.5% causes the effect of forming the martensite phase to be saturated. Accordingly, the Mn content should be set to be 0.05-1.5%. A preferable range should be 0.3-1.3% and a more preferable range should be 0.4-1.0%.

P: Not more than 0.03%

Phosphor is included as an impurity in steel. Moreover, P has a harmful influence on the toughness of the steel and deteriorates the corrosion resistance in a corrosive environment containing $CO_2$ and the like. Accordingly, the content should be as small as possible. However, there is no special problem at the content of not more than 0.03%. Accordingly, the upper limit should be set to be 0.03%. A preferable upper limit should be 0.02% and a more preferable upper limit should be 0.015%.

S: Not more than 0.01%

Sulfur is included as an impurity in steel, as similar to P, and has a harmful influence on the hot workability of the steel. Accordingly, the content should be as small as possible. However, there is no special problem at the content of not more than 0.01%. Accordingly, the upper limit should be set to be 0.01%. A preferable upper limit should be 0.005% and a more preferable upper limit should be 0.003%.

Cr: 9-15%

Chromium is a basic element in the maretensitic stainless steel according to the invention. In particular, Cr is an important element for enhancing the corrosion resistance and sulfide stress cracking resistance in a corrosive environment containing $CO_2$, $Cl^-$ and $H_2S$. Moreover, at an appropriate range of the Cr content, austenite phase is formed in the metal structure at a high temperature and martensite phase is formed to stabilize the metal structure in the quenching treatment. For this purpose, it is necessary to contain Cr in steel at a content of not less than 9%. However, an excessive content of Cr tends to generate ferrite in the metal structure and makes it difficult to obtain the martensite phase in the quenching treatment. Accordingly, the Cr content should be set to be 9-15%. A preferable range should be 9.5-13.5% and a more preferable range should be 9.5-11.7%.

Ni: 0.1-4.5%

Nickel is an effective element for forming austenite and has an effect of forming martensite to stabilize the metal structure in the quenching treatment. Moreover, Ni is an important element for enhancing the corrosion resistance and sulfide stress cracking resistance in a corrosive environment containing $CO_2$, $Cl^-$ and $H_2S$. Although an increasing content of C causes the Ni content to be decreased, a Ni content of not less than 0.1% is necessary to obtain the above effect. However, a Ni content of more than 4.5% causes the steel price to be increased. Accordingly, the Ni content should be set to be 0.1-4.5%. A preferable range should be 0.5-3.0% and a more preferable range should be 1.0-3.0%.

Al: Not more than 0.05%

Aluminum should not be always included in steel. However, Al is an effective element serving as a deoxidizer. When using as such a deoxidizer, the content should be set to be not less than 0.0005%. However, an Al content of more than 0.05% increases the amount of non-metallic inclusion particles, thereby causing the toughness and the corrosion resistance to be decreased. Accordingly, the Al content should be not more than 0.05%.

Cu: 0.05-5%

Copper is an effective element for forming sulfide in a corrosive environment containing a very small amount of $H_2S$. A copper sulfide itself prevents $H_2S$ from diffusing into the chromium oxide layer. The coexistence of molybdenum sulfide and copper sulfide further stabilizes the chromium oxide. In accordance with the invention, it is necessary to contain at least one of Cu and Mo. Therefore, it is not always necessary to contain Cu when Mo is contained. In the case of Cu being contained, a content of not less than 0.05% is required to obtain the above effect. However, a Cu content of not less than 5% causes the effect to be saturated. Accordingly, the upper limit should be set to be 5%. A preferable range of the Cu content should be 1.0-4.0% and a more preferable range should be 1.6-3.5%. Moreover, the lower limit of the Cu content is specified by the below formula (a) or (b).

Mo: 0.05-5%

Molybdenum is an element, which prevents the localized corrosion in an environment containing carbon oxide under the condition of coexistence of Cr, and which produces sulfide in a corrosive environment containing a very small amount of $H_2S$ to enhance the stability of the chromium oxide. In accordance with the invention, it is necessary to contain at least one of Cu and Mo. Therefore, it is not always necessary to contain Mo if Cu is conatained. In the case of Mo being contained, the above effect cannot be obtained at a content of less than 0.05%. Moreover, a Mo content of not less than 5% saturates the above effect, thereby making it impossible to further enhance the localized corrosion resistance and the sulfide stress cracking resistance. Accordingly, a preferable range of the Mo content should be 0.1-1.0% and a more preferable range should be 0.10-0.7%. Moreover, the lower limit of the Mo content is specified by the below formula (a) or (b).

N: Not more than 0.1%

Nitrogen is an effective element for forming austenite and has an effect of suppressing the generation of δ ferrite in the quenching treatment of the steel material and of forming martensite to stabilize the metal structure of the steel material. An N content of not less than 0.01% is required to obtain the above effect. However, An N content of more than 0.1% causes the toughness to be decreased. Accordingly, a preferable range of the N content should be 0.01-0.1% and a more preferable range should be 0.02-0.05%.

$$0.2\% \leqq Mo+Cu/4 \leqq 5\% \quad \text{Formula (a):}$$

$$0.55\% \leqq Mo+Cu/4 \leqq 5\% \quad \text{Formula (b):}$$

In order to obtain the sulfide stress cracking resistance in an environment containing a very small amount of $H_2S$, it is necessary to stabilize a passive film of chromium oxide formed on the stainless steel surface. Moreover, in order to stabilize a passive film in the corrosive environment containing $H_2S$, it is necessary to prevent the chromium oxide from dissolving due to the effect of $H_2S$ by forming the sulfide film on the chromium oxide layer. Cu or Mo is effective to form such a sulfide film. In particular, a sulfide film formed by a mixture of the copper sulfide and molybdenum sulfide enhances the effect of protecting the chromium oxide film due to the increased fine density of the layer.

Moreover, the condition of corrosive environment, in particular, pH influences the formation of such a sulfide film resulting from Cu and Mo. Qualitatively, a greater amount of Cu and/or Mo is required in the case of a decreased pH value, i.e., in a severer corrosive environment.

Figure 2:
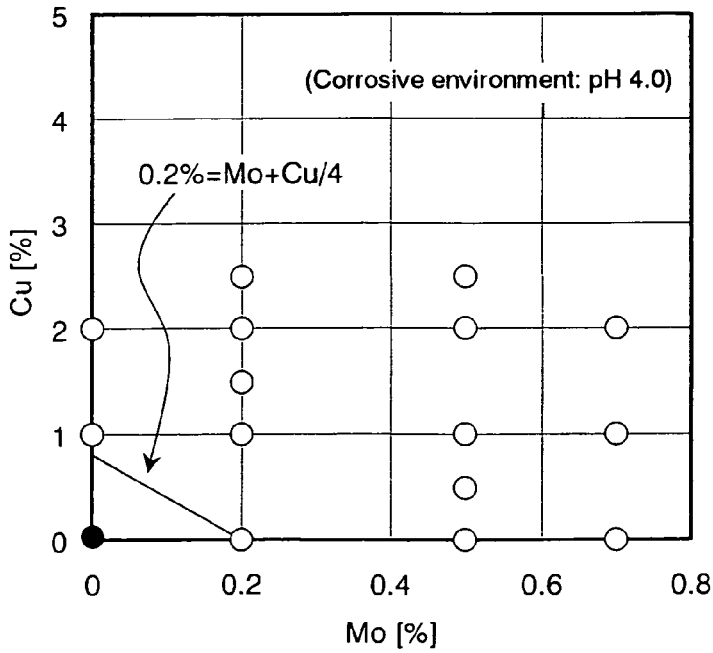
FIG. 2 is a diagram showing the influence of Mo and Cu contents on the sulfide stress cracking resistance in a corrosive environment of pH 4.0.

FIGS. 1 and 2 show the influence of the Mo and Cu content on the sulfide stress cracking resistance in the corrosive environments of pH 3.75 and pH 4.0, respectively. The test material used was 0.04% C-11% Cr-2% Ni—Cu—Mo steel, as described above. An actual yield stress was added to the respective four-point bend test with smooth specimen at 25° C. under test conditions of 300 Pa (0.003 bar) $H_2S$+3 MPa (30 bar) $CO_2$, 5% NaCl and pH 3.75 or pH 4.0, and the generation of cracks after 336 hours in the test was inspected. Marks ○ and ● in these diagrams indicate the existence and non-existence of sulfide stress cracking, respectively.

As shown in FIG. 1, in order to obtain excellent sulfide stress cracking resistance in a corrosive environment of not less than pH 3.75, it is necessary to satisfy the above formula (b); $0.55\% \leqq Mo+Cu/4 \leqq 5\%$. As shown in FIG. 2, in order to obtain excellent sulfide stress cracking resistance in an environment of not less than pH 4.0, it is necessary to satisfy the above formula (a); $0.2\% \leqq Mo+Cu/4 \leqq 5\%$. In this case, the relation of $Mo+Cu/4 \leqq 5\%$ results from the saturation of the effect in which the copper sulfide and molybdenum sulfide stabilize the chromium oxide film.

Accordingly, the Cu and Mo contents satisfying the formula (a) or (b) allows the mixture of the copper and molybdenum sulfides to be densely deposited on the chromium oxide film, thereby preventing the chromium oxide from being dissolved due to the effect of $H_2S$.

Moreover, the martensitic stainless steel according to the invention can contain one or more of the elements in the below Groups A and B.

Group A; Ti: 0.005-0.5%, V: 0.005-0.5% and Nb: 0.005-0.5%

These elements enhance the sulfide stress cracking resistance in a corrosive environment containing a very small amount of $H_2S$, and at the same time increase the tensile strength at a high temperature. Such effect can be obtained at a content of not less than 0.005% for all the elements. However, a content of more than 0.5% causes the toughness to be reduced. The Ti, V or Nb content should be set to be 0.005-0.5%, when the element is contained. For these elements, a preferable range of content should be 0.005-0.2% and a more preferable range should be 0.005-0.05%.

Group B; B: 0.0002-0.005%, Ca: 0.0003-0.005%, Mg: 0.0003-0.005% and rare earth elements: 0.0003-0.005%.

These elements enhance the hot workability of steel. Therefore, one or more of these elements may be contained therein, especially when intending to improve the hot workability of steel. Such effect can be obtained at a content of not less than 0.0002% in the case of B, and at a content of not less than 0.0003% in the case of Ca, Mg or rare earth elements. However, a content of more than 0.005% in anyone of these elements causes the toughness of steel to be decreased and thecorrosion resistance to be reduced in a corrosive environment containing $CO_2$ and the like. When added, the B content should be set to be 0.0002-0.005% and the content of Ca, Mg or rare earth elements should be set to be 0.0003-0.005%. For all the elements, a preferable range of content should be 0.0005-0.0030%, and a more preferable range should be 0.0005-0.0020%.

2. Metal Structure

In the martensitic stainless steel according to the present invention, the localized corrosion resistance at a high temperature requires the carbide amount of not more than 0.5 volume % in the grain boundaries of prior austenite in the steel.

Namely, carbides, in particular $M_{23}C_6$ type carbides, are preferentially precipitate in the grain boundaries of the prior austenite, thereby causing the localized corrosion resistance of the martensitic stainless steel to be reduced. When the amount of carbides mainly consisting of the $M_{23}C_6$ type ones in the grain boundaries of the prior austenite is more than 0.5 volume %, the localized corrosion occurs at a high temperature.

In the present invention, therefore, the carbide amount mainly in the grain boundaries of the prior austenite should be set to be not more than 0.5 volume %. A preferable upper limit of the amount should be 0.3 volume % and a more preferable upper limit of the amount should be 0.1 volume %. Since the corrosion resistance is excellent even in the case of no carbides existing in the grain boundaries of the prior austenite, the lower limit is not specifically specified.

The amount of carbides in the grain boundaries of the prior austenite described herein is determined by the following procedures: A extracted replica specimen is prepared, and 10 fields selected at random from an area of 25 μm×35 μm in the specimen thus prepared are observed at a magnification of 2,000 with an electron microscope. Then, the amount of carbides is determined as an average value from the area of the respective carbides existing in the form of a spot array by the point counting method. Moreover, the grain boundaries in the prior austenite mean the crystalline grain boundaries in the austenite state, which is a structure before the martensitic transformation.

3. Hardness

In the martensitic stainless steel according to the invention, it is necessary to set the hardness to be not less than 30 in HRC in order to obtain a desirable resistance to the corrosive wear in a corrosive environment containing $CO_2$ and a very small amount of $H_2S$. On the other hand, a hardness of more than 45 in HRC causes the effect of improving the resistance to corrosive wear in steel to be saturated and also the toughness to be deteriorated. Accordingly, the hardness of the steel should be set 30-45 in HRC. Moreover, a preferable range of the hardness should be 32-40 in HRC.

The martensitic stainless steel according to the invention may be obtained through a process in which steel having a specified chemical composition is hot worked and then a predetermined heat treatment is applied thereto. For instance, a steel material is heated in a temperature of the $Ac_3$ point or more, and then cooled by the quenching or air cooling (slow cooling) after hot worked. Alternately, the above treatment is applied to the steel material and it is thus cooled down to room temperature, and subsequently the steel material is quenched or air cooled in the final treatment, after again heating it at a temperature of the $Ac_3$ point or more. The quenching often provides too much increase in the hardness and a reduction in the toughness, so that the air cool is preferable to the quenching.

After cooled, the tempering can be applied in order to adjust the mechanical strength. However, the tempering at a high temperature provides not only a reduction in the mechanical strength of the steel, but also an increase in the amount of the carbides in the grain boundaries of the prior austenite, thereby causing the localized corrosion to be induced. In view of this fact, it is preferable that the tempering should be carried out at a low temperature of not more than 400° C. The hot work in the above treatments means the forging, plate rolling, steel pipe rolling or the like, and the steel pipe described herein means not only a seamless steel pipe but also a welded steel pipe.

EXAMPLES 19 types of steel, whose chemical composition is shown in Table 1, were used. Each type of the steels was melted by an experimental furnace and heated at 1,250° C. for 2 hours, and then forged to form a block. In steel Q, Mo+Cu/4 is outside of the range specified by the formula (a) or equation (b), and in steels R and S, the content of one or more components is outside the specified range. Therefore, steels Q, R and S are steels in comparative examples.

TABLE 1

| Type of steel | Chemical composition (mass %) | | | | | | | | | | |
|---|---|---|---|---|---|---|---|---|---|---|---|
| | C | Si | Mn | P | S | Cr | Ni | Mo | Cu | N | Al |
| A | 0.03 | 0.25 | 0.76 | 0.012 | 0.002 | 11.2 | 1.68 | 0.45 | 2.43 | 0.01 | 0.008 |
| B | 0.05 | 0.43 | 1.25 | 0.015 | 0.005 | 11.5 | 2.50 | 0.30 | 3.50 | 0.02 | 0.008 |
| C | 0.04 | 0.45 | 0.50 | 0.003 | 0.002 | 10.9 | 2.30 | 0.60 | 2.80 | 0.04 | 0.009 |
| D | 0.02 | 0.07 | 1.45 | 0.010 | 0.001 | 10.2 | 4.30 | 0.50 | 1.90 | 0.05 | 0.009 |
| E | 0.09 | 0.15 | 1.47 | 0.015 | 0.002 | 14.5 | 1.50 | 0.10 | 3.50 | 0.01 | 0.010 |
| F | 0.04 | 0.30 | 0.80 | 0.015 | 0.001 | 11.0 | 1.58 | 0.53 | 2.45 | 0.02 | 0.026 |
| G | 0.05 | 0.35 | 0.07 | 0.009 | 0.003 | 12.3 | 1.50 | 0.60 | 4.60 | 0.03 | 0.012 |
| H | 0.02 | 0.53 | 0.32 | 0.017 | 0.001 | 11.5 | 2.30 | 0.30 | 1.90 | 0.03 | 0.013 |
| I | 0.05 | 0.56 | 0.60 | 0.015 | 0.003 | 12.7 | 3.80 | 4.70 | 0.50 | 0.02 | 0.013 |
| J | 0.04 | 0.80 | 1.15 | 0.020 | 0.008 | 9.2 | 3.00 | 0.65 | 3.80 | 0.03 | 0.015 |
| K | 0.07 | 0.61 | 0.70 | 0.012 | 0.001 | 12.1 | 2.00 | 0.10 | 1.20 | 0.03 | 0.021 |
| L | 0.07 | 0.23 | 1.25 | 0.003 | 0.003 | 12.5 | 2.50 | 0.30 | 1.70 | 0.02 | 0.021 |
| M | 0.02 | 0.75 | 0.95 | 0.015 | 0.003 | 9.8 | 1.80 | 0.70 | 2.50 | 0.05 | 0.025 |
| N | 0.04 | 0.32 | 0.76 | 0.016 | 0.001 | 11.0 | 1.48 | 0.25 | 1.94 | 0.02 | 0.036 |
| O | 0.05 | 0.35 | 1.35 | 0.005 | 0.002 | 11.5 | 1.50 | 0.70 | 2.70 | 0.04 | 0.041 |
| P | 0.03 | 0.35 | 0.80 | 0.023 | 0.002 | 10.5 | 3.00 | 0.00 | 1.70 | 0.01 | 0.007 |
| Q | 0.02 | 0.53 | 0.32 | 0.017 | 0.001 | 11.5 | 2.30 | 0.05 | 0.12 | 0.03 | 0.013 |
| R | *0.15 | 0.35 | 1.35 | 0.003 | 0.002 | 11.9 | 1.50 | 0.60 | 2.80 | 0.06 | 0.019 |
| S | 0.04 | 0.75 | 0.95 | 0.015 | 0.003 | *7.5 | 1.80 | 2.00 | 0.19 | 0.05 | 0.025 |

| Type of steel | Residual: Fe and impurities | | | | | | | |
|---|---|---|---|---|---|---|---|---|
| | Nb | Ti | V | B | Ca | Mg | REM | Mo + Cu/4 |
| A | | | 0.049 | | 0.0018 | | | 1.06 |
| B | 0.030 | | | | | | | 1.18 |
| C | | | | | 0.0007 | | | 1.30 |
| D | | | | | | | | 0.98 |
| E | | | | | | | | 0.98 |
| F | | | 0.050 | | 0.0017 | | | 1.14 |
| G | | | | | | | | 1.75 |
| H | | | | | | | | 0.78 |
| I | | | | | | | | 4.83 |
| J | | 0.010 | | | | | | 1.60 |
| K | | | | 0.0008 | | | | 0.40 |
| L | | | | | | | | 0.73 |
| M | | | | | | 0.0010 | | 1.33 |
| N | | | 0.050 | | | | | 0.74 |
| O | | | | | | | 0.0012 | 1.38 |
| P | | | 0.020 | | | | | 0.43 |
| Q | | | | | | | | *0.08 |
| R | | | | | | | | 1.30 |
| S | | 0.050 | | | | | | 2.05 |

Note)
The symbol "*" indicates the outside the range specified by the invention.
REM: rare earth elements.

The block thus prepared was heated at 1,250° C. for 1 hr and then hot rolled to form a steel plate having a 15 mm thickness. Thereafter, a test material was prepared by applying one of various heat treatments to the steel plate. The process employed is a combination of treatments, AC, AC+LT, AC+HT, WQ, WQ+LT and WQ+HT, as shown in Tables 2 and 3, where the content of treatment in each symbol is as follows:

AC: Air cooled after hot rolling.

WQ: Water cooled after hot rolling.

LT: Air cooled after heating at 250° C. for 30 min.

HT: Air cooled after heating at 600° C. for 30 min.

TABLE 2

| Test No. | Type of steel | Process of production | Yield stress (MPa) | Hardness (HRC) | Carbide amount on grain boundaries (volume %) | Mo + Cu/4 (%) | Corrosion test condition (pH) | Evaluation results of corrosion resistance: Sulfide stress cracking test | Corrosive wear test | Localized corrosion test | Classification |
|---|---|---|---|---|---|---|---|---|---|---|---|
| 1 | A | AC | 834 | 31.3 | 0.04 | 1.06 | 3.75 | ○ | ○ | ○ | Inventive examples |
| 2 | B | AC | 899 | 34.9 | 0.07 | 1.18 | 3.75 | ○ | ○ | ○ | |
| 3 | C | AC | 905 | 35.3 | 0.06 | 1.30 | 3.75 | ○ | ○ | ○ | |
| 4 | C | WQ | 932 | 35.5 | 0 | 1.30 | 3.75 | ○ | ○ | ○ | |
| 5 | C | AC + LT | 904 | 36.2 | 0.05 | 1.30 | 3.752 | ○ | ○ | ○ | |
| 6 | D | AC | 886 | 34.0 | 0.02 | 0.98 | 3.75 | ○ | ○ | ○ | |
| 7 | E | AC | 960 | 37.9 | 0.13 | 0.98 | 3.75 | ○ | ○ | ○ | |
| 8 | F | AC | 860 | 32.4 | 0.06 | 1.14 | 3.75 | ○ | ○ | ○ | |
| 9 | F | AC + LT | 862 | 33.0 | 0.06 | 1.14 | 3.75 | ○ | ○ | ○ | |
| 10 | F | WQ + HT | 660 | *28.3 | *0.75 | 1.14 | 3.75 | ○ | X | X | Comparative example |
| 11 | G | AC | 884 | 33.6 | 0.07 | 1.75 | 3.75 | ○ | ○ | ○ | Inventive examples |
| 12 | H | AC | 817 | 30.2 | 0.02 | 0.78 | 3.75 | ○ | ○ | ○ | |
| 13 | H | WQ | 815 | 30.7 | 0 | 0.78 | 3.75 | ○ | ○ | ○ | |
| 14 | H | AC + LT | 813 | 30.5 | 0.02 | 0.78 | 3.75 | ○ | ○ | ○ | |
| 15 | I | AC | 908 | 34.9 | 0.07 | 4.83 | 3.75 | ○ | ○ | ○ | |
| 16 | J | AC | 855 | 32.8 | 0.06 | 1.60 | 3.75 | ○ | ○ | ○ | |
| 17 | K | AC | 953 | 37.5 | 0.11 | 0.40 | 3.75 | ○ | ○ | ○ | |

Note)
the symbol "*" indicates the outside the range specified by the invention.
AC: Air cooled after hot rolling.
WQ: Water cooled after hot rolling.
LT: Air cooled after heating at 250□ for 30 min.
HT: Air cooled after heating at 600□ for 30 min.

TABLE 3

| Test No. | Type of steel | Process of production | Yield stress (MPa) | Hardness (HRC) | Carbide amount on grain boundaries (volume %) | Mo + Cu/4 (%) | Corrosion test condition (pH) | Evaluation results of corrosion resistance: Sulfide stress cracking test | Corrosive wear test | Localized corrosion test | Classification |
|---|---|---|---|---|---|---|---|---|---|---|---|
| 18 | K | AC + HT | 747 | *28.0 | *0.85 | 0.40 | 3.75 | ○ | X | X | Comparative example |
| 19 | L | AC | 906 | 34.7 | 0.10 | 0.73 | 3.75 | ○ | ○ | ○ | Inventive examples |
| 20 | M | AC | 874 | 33.1 | 0.02 | 1.33 | 3.75 | ○ | ○ | ○ | |
| 21 | N | AC | 865 | 33.0 | 0.05 | 0.74 | 3.75 | ○ | ○ | ○ | |
| 22 | N | AC + LT | 866 | 32.0 | 0.05 | 0.74 | 3.75 | ○ | ○ | ○ | |
| 23 | N | WQ + LT | 862 | 32.4 | 0 | 0.74 | 3.75 | ○ | ○ | ○ | |
| 24 | N | AC + HT | 655 | *27.2 | *0.65 | 0.74 | 3.75 | ○ | X | X | Comparative example |
| 25 | O | AC | 905 | 35.1 | 0.07 | 1.38 | 3.75 | ○ | ○ | ○ | Inventive example |
| 26 | P | AC | 842 | 30.6 | 0.04 | *0.43 | 3.75 | X | ○ | X | Comparative examples |
| 27 | *Q | WQ | 846 | 32.5 | 0 | *0.08 | 3.75 | X | ○ | ○ | |
| 28 | *R | AC | 1233 | *47.0 | 0.22 | 1.30 | 3.75 | X | ○ | X | |
| 29 | *S | AC | 888 | 34.0 | 0.05 | 2.05 | 3.75 | X | X | X | |
| 30 | P | AC | 842 | 30.6 | 0.04 | 0.43 | 4.0 | ○ | ○ | ○ | Inventive example |

Note)
the symbol "*" indicates the outside the range specified by the invention.

Each test material thus prepared was machined to form a corresponding test piece. The tensile test and the hardness test were carried out, using these test pieces. Thereafter, tests on the measurement of the amount of carbides in the grain boundaries of the prior austenite, the sulfide stress cracking resistance, the resistance to corrosive wear and the localized corrosion resistance were carried out under various conditions described below:

First, in the measurement of the carbide amount in the grain boundaries of the prior austenite, an extracted replica specimen was prepared from each test piece, and then ten fields having an area of 25 μm×35 μm selected at random therefrom were observed at a magnification of 2,000 by an electron microscope. The areas of carbides existing in the form of spot array on the grain boundaries of the prior austenite were determined by the point counting method, and the amount of carbides was determined averaging the areas thus obtained.

Next, in the test of the sulfide stress cracking resistance, a four-point bend test with smooth specimen (10 mm width×2 mm thickness×75 mm length) was used as a test piece and stress of 100% actual yield strength was added thereto. In this case, the test environment was controlled under the conditions: 25° C., 300 Pa (0.003 bar) $H_2S$+3 MPa (30 bar) $CO_2$, 5% NaCl, pH 3.75 or pH 4.0 and a test time of 336 hours. The test result was evaluated by observing cracks with the naked eye. The non-existence and existence of the sulfide stress cracking are indicated by ○ and x, respectively.

Moreover, in the test of the resistance to corrosive wear, a coupon specimen (20 mm width×2 mm thickness×30 mm length) was used as a test piece. A test solution including 300 Pa (0.003 bar) $H_2S$+100 kPa (1 bar) $CO_2$, 5% NaCl under a corrosive environment of pH 3.75 or pH 4.0 was splayed at a flow rate of 50 m/s and at 25° C. for 336 hours from a jet nozzle to the surface of the test piece. The test result was evaluated by observing the corrosive wears with the naked eye. The non-existence and existence of the corrosive wear are indicated by ○ and x, respectively.

Finally, in the test of the localized corrosion resistance, a coupon specimen (20 mm width×2 mm thickness×50 mm length) was used as a test piece. In this case, the test environment was controlled under the conditions: 150° C., 300 Pa (0.003 bar) $H_2S$+3 MPa (30 bar) $CO_2$, 25% NaCl, pH 3.75 or pH 4.0 and a test time of 336 hours. The test result was evaluated from the localized corrosion observed with the naked eye. The non-existence and existence of the localized corrosion are indicated by ○ and x, respectively. All of the test results and the evaluation results are listed in Tables 2 and 3.

Test Nos. 10, 18, 24, and 26 to 29 pertain to the comparative examples: In the test Nos. 26 to 29 the chemical composition is outside the range specified by the invention; in the test No. 26, the formula (b) is not satisfied and in the test No. 27, neither the formula (a) nor the formula (b) is satisfied; in the test Nos. 10, 18, 24 and 28, the hardness is outside the range specified by the invention; and in the test Nos. 10, 18 and 24, the amount of carbides in the grain boundaries of the prior austenite is outside the range specified by the invention. In the comparative examples, all the specimens exhibit either crack or corrosion in the evaluation tests for the sulfide stress cracking, the corrosive wear and the localized corrosion. However, in the inventive examples satisfying all the requirements, excellent results were obtained in every evaluation test of corrosion.

INDUSTRIAL APPLICABILITY

The martensitic stainless steel according to the present invention provides excellent properties regarding the sulfide stress cracking resistance, the resistance to corrosive wear and the localized corrosion resistance. As a result, the work in the oil well can be done at a higher flow speed of oil or gas than that employed in the conventional oil well, thereby enabling the operation efficiency to be enhanced in the work of oil wells.

The invention claimed is:

1. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, and Mo: 0.05-5% in mass %, the residual being Fe and impurities, wherein the contents of Cu and Mo satisfy the following formula (a), $$0.2\% \leqq Mo+Cu/4 \leqq 5\% \quad (a)$$

and wherein the hardness is 30-45 in HRC and the amount of carbides in grain boundaries of prior austenite is not more than 0.13 volume %, a yield strength of the steel after cooling by quenching or air cooling in a final treatment after final heating at a temperature of the $Ac_3$ point or more is not less than 815 MPa.

2. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, and Mo: 0.05-5% in mass %, the residual being Fe and impurities, wherein the contents of Cu and Mo satisfy the following formula (b), $$0.55\% \leqq Mo+Cu/4 \leqq 5\% \quad (b)$$

and wherein the hardness is 30-45 in HRC and the amount of carbides in grain boundaries of prior austenite is not more than 0.13 volume %, and a yield strength of the steel after cooling by quenching or air cooling in a final treatment after final heating at a temperature of the $Ac_3$ point or more is not less than 815 MPa.

3. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, Mo: 0.05-5%, and at least one of the elements of Ti: 0.005-0.5%, V: 0.005-0.5% and Nb: 0.005-0.5% in mass %, the residual being Fe and impurities, wherein the contents of Cu and Mo satisfy the following formula (a), $$0.2\% \leqq Mo+Cu/4 \leqq 5\% \quad (a)$$

and wherein the hardness is 30-45 in HRC the amount of carbides in grain boundaries of prior austenite is not more than 0.13 volume %, and a yield strength of the steel after cooling by quenching or air cooling in a final treatment after final heating at a temperature of the $Ac_3$ point or more is not less than 815 MPa.

4. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, Mo: 0.05-5%, and at least one of the elements of Ti: 0.005-0.5%, V: 0.005-0.5% and Nb: 0.005-0.5% in mass %, the residual being Fe and impurities, wherein the contents of Cu and Mo satisfy the following formula (b), $$0.55\% \leqq Mo+Cu/4 \leqq 5\% \quad (b)$$

and wherein the hardness is 30-45 in HRC and the amount of carbides in grain boundaries of prior austenite is not more than 0.13 volume %, and a yield strength of the steel after cooling by quenching or air cooling in a final treatment after final heating at a temperature of the $Ac_3$ point or more is not less than 815 MPa.

5. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, and Mo: 0.05-5% in mass %, the residual being Fe and impurities, wherein the contents of Cu satisfy the following formula (a), $$0.2\% \leqq Mo+Cu/4 \leqq 5\% \quad (a)$$

and wherein the hardness is 30-45 in HRC, the amount of carbides in grain boundaries of prior austenite is not more than 0.13 volume %, the martensitic stainless steel having a structure resulting from one of quenching, air cooling, quenching followed by a 400° C. or lower tempering treatment, or air cooling followed by a 400° C. or lower tempering treatment, and a yield strength of the steel after cooling by quenching or air cooling in a final treatment after final heating at a temperature of the $Ac_3$ point or more is not less than 815 MPa, and the amounts of Cu and Mo effective to form a sulfide layer on a formed chromium oxide layer, the sulfide layer formed as a result of the martensitic stainless steel being subjected to a sulfur-containing environment.

6. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, and N: not more than 0.1%, Cu: 0.05-5%, and Mo: 0.05-5% in mass %, the residual being Fe and impurities, wherein the contents of Cu and Mo satisfy the following formula (b), $$0.55\% \leqq Mo+Cu/4 \leqq 5\% \quad (b)$$

and wherein the hardness is 30-45 in HRC, the amount of carbides in grain boundaries of prior austenite is not more than 0.13 volume %, the martensitic stainless steel having a structure resulting from one of quenching, air cooling, quenching followed by a 400° C. or lower tempering treatment, or air cooling followed by a 400° C. or lower tempering treatment, and a yield strength of the steel after cooling by quenching or air cooling in a final treatment after final heating at a temperature of the $Ac_3$ point or more is not less than 815 MPa, and the amounts of Cu and Mo effective to form a sulfide layer on a formed chromium oxide layer, the sulfide layer formed as a result of the martensitic stainless steel being subjected to a sulfur-containing environment.

7. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, and Mo: 0.05-5%, and at least one of the elements of Ti: 0.005-0.5%, V: 0.005-0.5% and Nb: 0.005-0.5% in mass %, the residual being Fe and impurities, wherein the contents of Cu and Mo satisfy the following formula (a), $$0.2\% \leqq Mo+Cu/4 \leqq 5\% \quad (a)$$

and wherein the hardness is 30-45 in HRC, the amount of carbides in grain boundaries of prior austenite is not more than 0.13 volume %, the martensitic stainless steel having a structure resulting from one of quenching, air cooling, quenching followed by a 400° C. or lower tempering treatment, or air cooling followed by a 400° C. or lower tempering treatment, and a yield strength of the steel after cooling by quenching or air cooling in a final treatment after final heating at a temperature of the $Ac_3$ point or more is not less than 815 MPa, and the amounts of Cu and Mo effective to form a sulfide layer on a formed chromium oxide layer, the sulfide layer formed as a result of the martensitic stainless steel being subjected to a sulfur-containing environment.

8. A martensitic stainless steel consisting of C: 0.02-0.09%, Si: 0.05-1.0%, Mn: 0.05-0.95%, P: not more than 0.03%, S: not more than 0.01%, Cr: 9-15%, Ni: 1.0-4.5%, Al: not more than 0.05%, N: not more than 0.1%, Cu: 0.05-5%, Mo: 0.05-5%, and at least one of the elements of Ti: 0.005-0.5%, V: 0.005-0.5% and Nb: 0.005-0.5% in mass %, the residual being Fe and impurities, wherein the contents of Cu and Mo satisfy the following formula (b), $$0.55\% \leqq Mo+Cu/4 \leqq 5\% \quad (b)$$

and wherein the hardness is 30-45 in HRC, the amount of carbides in grain boundaries of prior austenite is not more than 0.13 volume %, the martensitic stainless steel having a structure resulting from one of quenching, air cooling, quenching followed by a 400° C. or lower tempering treatment, or air cooling followed by a 400° C. or lower tempering treatment, and a yield strength of the steel after cooling by quenching or air cooling in a final treatment after final heating at a temperature of the $Ac_3$ point or more is not less than 815 MPa, and the amounts of Cu and Mo effective to form a sulfide layer on a formed chromium oxide layer, the sulfide layer formed as a result of the martensitic stainless steel being subjected to a sulfur-containing environment.

* * * * *